US007794039B2

(12) United States Patent
Kinoshita

(10) Patent No.: US 7,794,039 B2
(45) Date of Patent: Sep. 14, 2010

(54) RECORDING APPARATUS

(75) Inventor: Hiroyuki Kinoshita, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 380 days.

(21) Appl. No.: 11/218,749

(22) Filed: Sep. 2, 2005

(65) Prior Publication Data

US 2006/0082632 A1 Apr. 20, 2006

(30) Foreign Application Priority Data

Oct. 15, 2004 (JP) ..... 2004-301372

(51) Int. Cl.
*B41J 29/393* (2006.01)

(52) U.S. Cl. ..... 347/19; 347/16; 347/67; 347/14; 347/101

(58) Field of Classification Search ..... 347/16, 347/19, 101, 104, 105, 67, 8, 5, 14
See application file for complete search history.

(56) References Cited

U.S. PATENT DOCUMENTS 6,018,640 A * 1/2000 Blackman et al. ..... 399/364
6,416,151 B1 7/2002 Otsuka
6,511,239 B1 * 1/2003 Kretschmann et al. ..... 400/579
6,966,713 B2 * 11/2005 Kim ..... 400/76
7,140,708 B2 * 11/2006 Lawrence et al. ..... 347/14
2002/0130917 A1 * 9/2002 Mitsui et al. ..... 347/29
2003/0067503 A1 * 4/2003 Cunnagin et al. ..... 347/19
2003/0222936 A1 * 12/2003 Kaneko ..... 347/19
2004/0126164 A1 * 7/2004 Ohyama ..... 400/58
2004/0183850 A1 * 9/2004 Takeuchi et al. ..... 347/19
2005/0073544 A1 * 4/2005 Scofield et al. ..... 347/16
2006/0023052 A1 * 2/2006 Watanabe et al. ..... 347/104

* cited by examiner

*Primary Examiner*—Matthew Luu
*Assistant Examiner*—Henok Legesse
(74) *Attorney, Agent, or Firm*—Canon U.S.A., Inc. I.P. Division

(57) ABSTRACT

A recording apparatus is provided which is capable of detecting a width and a position of a recording paper sheet with a simple configuration and does not cause a positional deviation of an image. The recording apparatus includes a carriage configured to reciprocate and having a recording head mounted thereon, and a sensor disposed on the carriage to detect an image recorded on the recording medium. The sensor is configured detect an end portion in a width direction of the recording medium.

4 Claims, 4 Drawing Sheets

RECORDING APPARATUS

BACKGROUND OF THE INVENTION

1. Field of the Invention

The present invention relates to a recording apparatus for recording on a recording medium by reciprocating scan of a carriage having a recording head mounted thereon. More particularly, the present invention relates to a recording apparatus having a device for reading a result of recording on the recording medium and for automatically adjusting a recording position.

2. Description of the Related Art

The adjustment of a recording position of this kind is known as a registration operation in which the relative positional relationship of dots formed by each of a forward scanning and a rearward scanning of the recording head is adjusted to a regular relationship, and is also known as a positioning operation in which the relative positional relationship of dots formed by each of a plurality of recording heads is adjusted to a regular relationship. Specific methods of the positioning processing include a method in which, in the case of the positioning in reciprocating scanning, a predetermined pattern constituted by a plurality of dots for each of the forward scanning and the rearward scanning is recorded on a plurality of recording paper sheets at a forming timing different for each of the patterns, for example, and the recorded patterns are read by an optical measurement device. Then, a pattern materializing the positional relationship of the dots best is selected in accordance with a result of the reading, and a dot forming timing at the time of recording is set in accordance with the forming timing corresponding to the selected pattern. The positioning between a plurality of recording heads can also be carried out in substantially the same way. Hereinafter, such a positioning is referred to as an automatic registration adjustment in distinction from a manual registration adjustment or a registration adjustment by means of an operation by a user. One example of the automatic registration adjustment is described in U.S. Pat. No. 6,416,151.

In recent years, a double-side recording apparatus for automatically recording on both sides of a recording paper sheet is in widespread use. In the double-side recording apparatus, after the recording on a first side of the recording paper sheet is carried out by a recording head, the sides of the recording paper sheet are reversed by a reversing mechanism, and then the recording is carried out on a second side of the recording paper sheet by the recording head. In the double-side recording apparatus, it is possible that a positional deviation of the recording paper sheet occurs when the recording paper sheet is reversed by a reversing operation, and, hence, there is a problem that the positional deviation of a recorded image occurs.

SUMMARY OF THE INVENTION

The present invention is directed to a recording apparatus that is capable of detecting a width and a position of a recording medium with a simple configuration and that does not cause a positional deviation of a recorded image.

In one aspect of the present invention, a recording apparatus for recording an image on a recording medium using a recording head while conveying the recording medium, the recording apparatus includes a carriage configured to reciprocate and having the recording head mounted thereon, and a sensor disposed on the carriage to detect an image recorded on the recording medium, wherein the sensor is configured detect an end portion in a width direction of the recording medium.

Further features of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE EMBODIMENTS

Embodiments of the invention will be described in detail below with reference to the drawings.

First Embodiment

Figure 1:
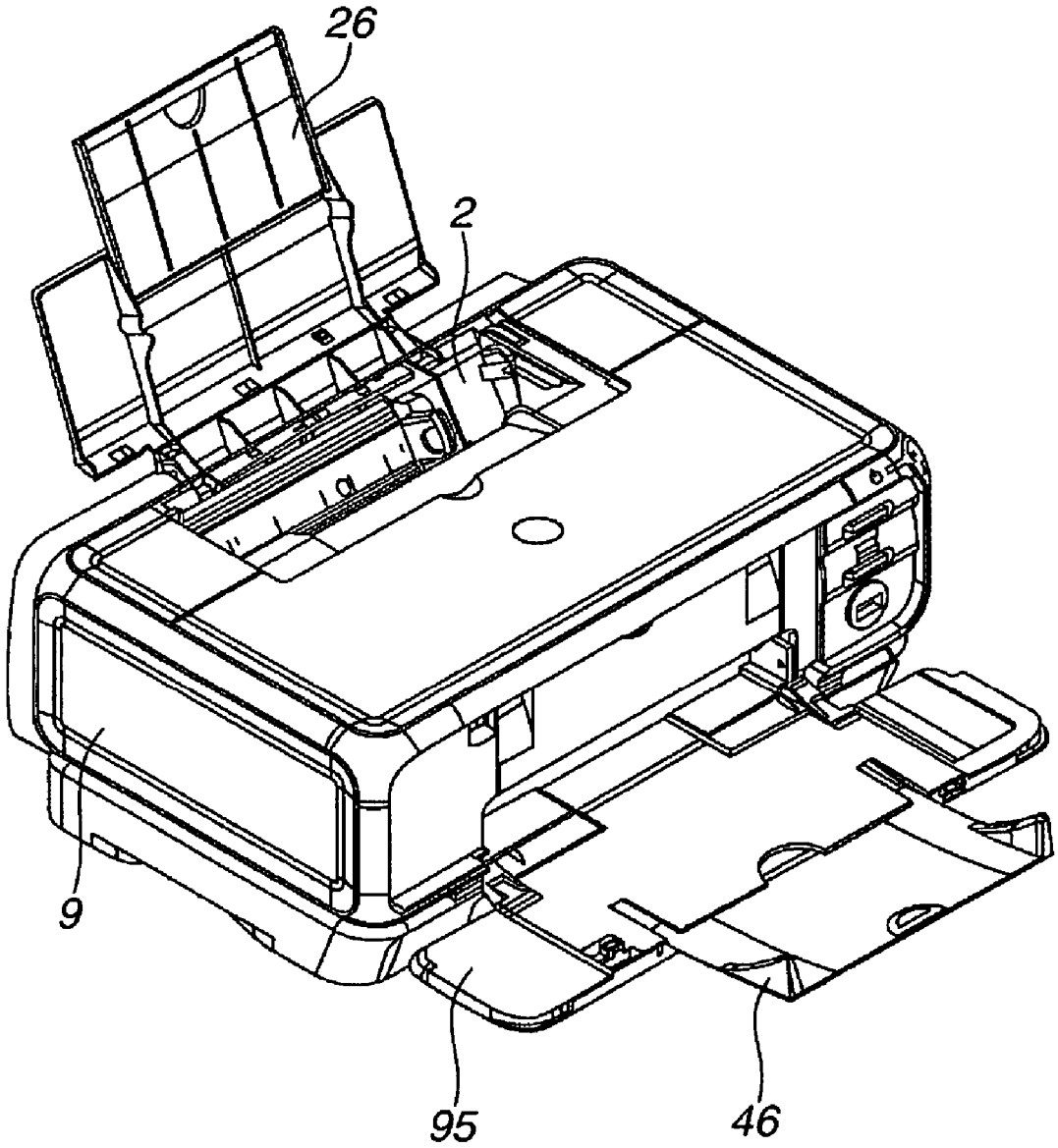
FIG. 1 is a perspective view of a recording apparatus according to each of embodiments of the present invention.
Figure 2:
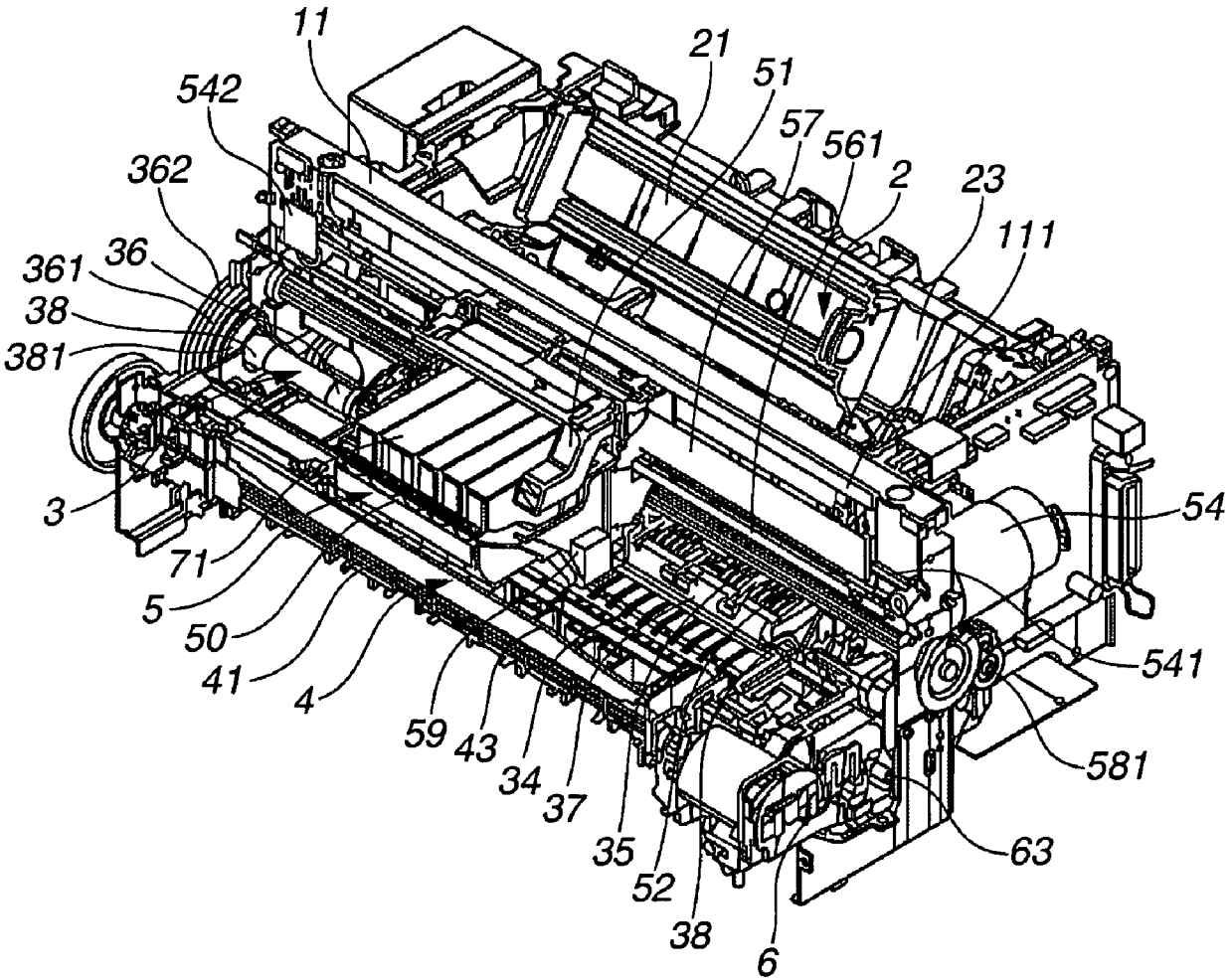
FIG. 2 is a perspective view of a mechanical section of the recording apparatus according to each of embodiments of the present invention.
Figure 3:
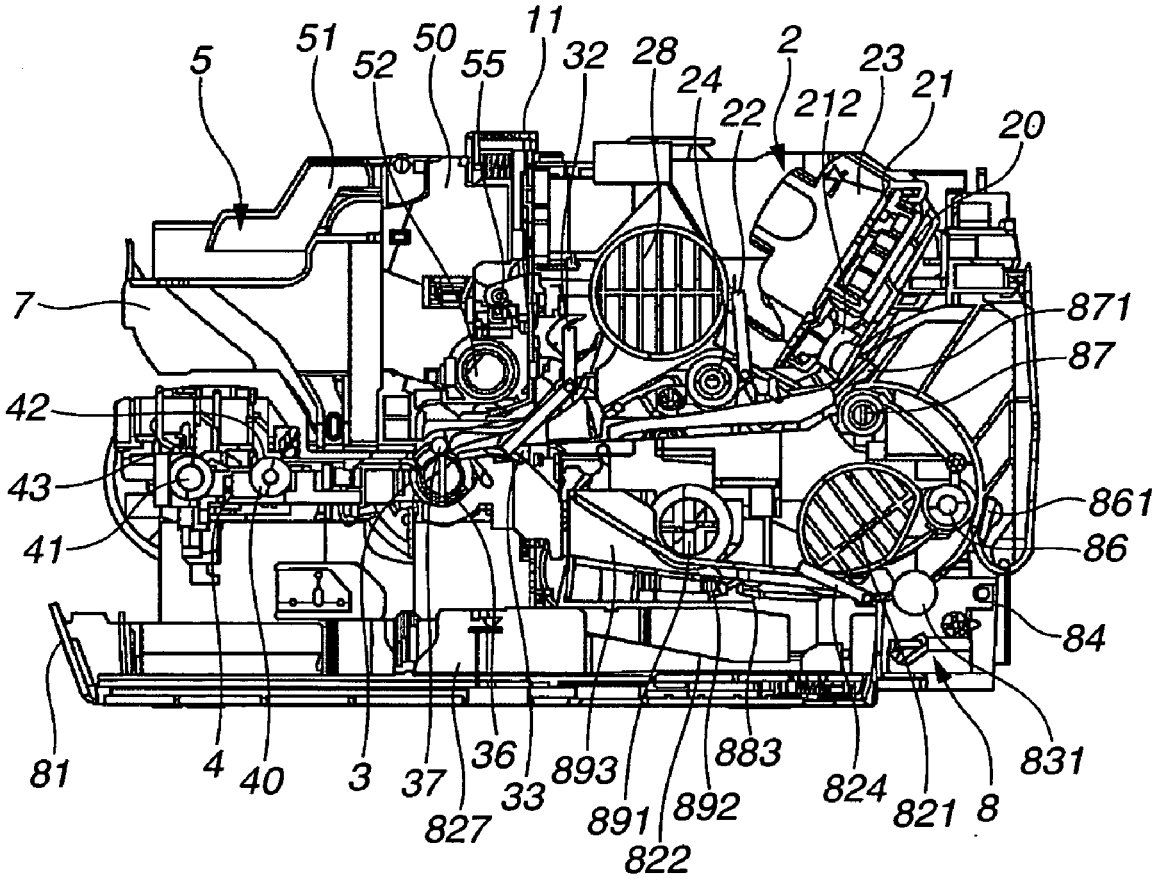
FIG. 3 is a longitudinal sectional view of the recording apparatus according to each of embodiments of the present invention.

A first embodiment of the present invention will be described with reference to FIGS. 1 to 3. FIG. 1 is a perspective view of a recording apparatus according to each of embodiments of the present invention. FIG. 2 is a perspective view of a mechanical section of the recording apparatus according to each of embodiments of the present invention. FIG. 3 is a longitudinal sectional view of the recording apparatus according to each of embodiments of the present invention.

The recording apparatus according to each of embodiments of the present invention includes a sheet feed section 2, a sheet convey section 3, a carriage section 5, a sheet discharge section 4, a U-turn and automatic double-side conveyance section 8, and a recording head 7. In this regard, an outline of each of these sections will be described one by one independently for each item.

(A) Sheet Feed Section

In FIGS. 1 to 3, in the sheet feed section 2, a pressure plate 21 for loading a recording paper sheet thereon, a sheet feed roller 28 for feeding the recording paper sheet, a separation roller 24 for separating the recording paper sheet, a return lever 22 for returning the recording paper sheet to a loading position, and the like are mounted on a base 20.

A sheet feed tray 26 for retaining the stacked recording paper sheet is mounted on the base 20 or an outer surface member. The sheet feed tray 26 is a multi-stage type. When the sheet feed tray 26 is used, the sheet feed tray 26 is pulled out. The sheet feed roller 28 is circular-arc-shaped in cross section and is rod-shaped. At the side of a paper sheet reference, one sheet feed roller rubber is provided on the sheet feed roller 28, and the recording paper sheet is fed by the sheet feed roller 28. The driving force to the sheet feed roller 28 is transmitted from a motor (not shown) in common use with a cleaning section (not shown) which is provided in the sheet feed section 2.

The pressure plate 21 is provided with a movable side guide 23, which is movably installed, to regulate the loading position of the recording paper sheet. The pressure plate 21 is rotatable around a rotation shaft joined to the base 20, and is urged towards the sheet feed roller 28 by a pressure plate spring 212. At a portion of the pressure plate 21 opposed to the sheet feed roller 28, there is provided a separation sheet (not shown) made of a material with a great friction coefficient such as artificial leather for preventing a double feed of the recording paper sheet when the stacking is close to an end. The pressure plate 21 is configured to contact and separate from the sheet feed roller 28.

In addition, the separation roller 24 for separating the recording paper sheet one by one is attached to a separation roller holder (not shown). Further, the separation roller 24 is mounted on the base 20 and is urged towards the sheet feed roller 28 by a spring and the like. The separation roller 24 is provided with a clutch spring (not shown). The clutch spring has a configuration such that a portion to which the separation roller 24 is attached can be rotated when a load of a predetermined amount or more is applied. The separation roller 24 can contact and separate from the sheet feed roller 28. The positions of the pressure plate 21, the return lever 22, and the separation roller 24 are detected by an ASF sensor (not shown).

In addition, the return lever 22 for returning the recording paper sheet to the loading position is rotatably mounted on the base 20, and is urged in a direction of release by a return lever spring (not shown). The return lever 22 is rotated by a control cam (not shown) when the recording paper sheet is returned.

In a normal standby state, the pressure plate 21 is released, the separation roller 24 is released by the control cam, and the return lever 22 returns the recording paper sheet. The return lever 22 is located at the loading position to close an aperture for loading, so that the recording paper sheet does not enter the inside of the recording apparatus through the aperture. When the sheet feeding is started from this standby state, the separation roller 24 is caused to contact the sheet feed roller 28 by the driving of a motor (not shown). Then, the return lever 22 is released, and the pressure plate 21 contacts the sheet feed roller 28. In this state, the feeding of the recording paper sheet is started. The recording paper sheet is restricted by a first-stage separation section (not shown) provided on the base 20. A predetermined number of recording paper sheets only are forwarded to a nip portion constituted by the sheet feed roller 28 and the separation roller 24. The forwarded recording paper sheets are separated at the nip portion, and only a recording paper sheet at the top is fed.

When the recording paper sheet reaches a conveyance roller 36 and a pinch roller 37, the pressure plate 21 is released by a pressure plate cam (not shown), and the separation roller 24 is released by the control cam. At this time, the return lever 22 is made to return to the loading position by the control cam. In addition, at this time, the recording paper sheet which has reached the nip portion constituted by the sheet feed roller 28 and the separation roller 24 can be returned to the loading position.

(B) Sheet Convey Section

The sheet convey section 3 is attached to a chassis 11 constituted by a plate metal which is integrally bent. The sheet convey section 3 is provided with the conveyance roller 36 for conveying the recording paper sheet, and a PE sensor (not shown). The conveyance roller 36 has a configuration such that a surface of a metal shaft is coated with fine particles of a ceramic and that a metal portion of each end of the shaft is received by a bearing 38, and is mounted on the chassis 11. In order to apply a load of a rotational axis to the conveyance roller 36 and to carry out a stable conveyance, a conveyance roller tension spring 381 is provided between the bearing 38 and the conveyance roller 36. Thus, a predetermined load is applied by urging the conveyance roller 36 via the conveyance roller tension spring 381.

A plurality of pinch rollers 37 are provided to contact the conveyance roller 36. The pinch rollers 37 follow the rotation of the conveyance roller 36. The pinch roller 37 is held by a pinch roller holder 35. By urging the pinch roller 37 via a pinch roller spring (not shown), the pinch roller 37 comes into pressure contact with the conveyance roller 36 to generate a conveyance force for the recording paper sheet. A rotation fulcrum shaft (not shown) of the pinch roller holder 35 is attached to a bearing of the chassis 11, and the pinch roller 37 rotates around the rotation fulcrum shaft. Further, at an entrance of the sheet convey section 3, to which the recording paper sheet is conveyed, a paper guide flapper 33 for guiding the recording paper sheet and a platen (supporting member) 34 are disposed. In addition, a PE sensor lever 32 for transferring a detection result of a leading edge and a trailing edge of the recording paper sheet to the PE sensor is mounted on the pinch roller holder 35. The platen 34 is attached to the chassis 11 and is positioned. The paper guide flapper 33 fits with the conveyance roller 36. The paper guide flapper 33 is rotatable around a sliding bearing portion (not shown) and is positioned by contacting the chassis 11.

In the above configuration, the recording paper sheet, which is forwarded to the sheet convey section 3, is guided by the pinch roller holder 35 and the paper guide flapper 33 and is forwarded to a roller pair composed of the conveyance roller 36 and the pinch roller 37. At this time, the PE sensor lever 32 detects the leading edge of the conveyed paper sheet so as to thereby find a recording position of the recording paper sheet. In addition, the recording paper sheet is conveyed onto the platen 34 by the rotation of the roller pair composed of the conveyance roller 36 and the pinch roller 37, which are rotated by a conveyance motor (not shown) . On the platen 34, ribs that act as a conveyance reference surface are formed. The ribs control the gap between the recording head 7 and the platen 34 and also control the waving of the recording paper sheet together with a sheet discharge section to be described later, thus preventing the recording paper sheet from waving too much.

The conveyance roller 36 is driven by transmitting a rotational force of the conveyance motor (not shown), which is, for example, a DC motor, to a pulley 361 provided on the shaft of the conveyance roller 36 via a timing belt (not shown). In addition, on the shaft of the conveyance roller 36, a code wheel 362, on which a marking is formed at a pitch of 150 lpi to 300 lpi for detecting an amount of conveyance by the conveyance roller 36, is provided. An encoder sensor (not shown) for reading the code wheel 362 is attached to a position adjacent to the code wheel 362 of the chassis 11.

In addition, at the downstream side of the conveyance roller 36 in the direction of conveyance of the recording paper sheet, the recording head 7 for forming an image based on image information is provided. The recording head 7 is provided with inkjet recording heads having respective color ink tanks 71 mounted thereon, which are separately exchangeable. The recording head 7 is capable of applying heat to ink via a heater or the like. Thus, ink is film-boiled by the heat. The heated ink is discharged from a nozzle of the recording head 7 by a variance in pressure occurring due to growth or contraction of bubbles arising due to the film boiling. An image is then formed on the recording paper sheet.

(C) Carriage Section

The carriage section 5 is provided with a carriage 50 for attaching the recording head 7 thereto. The carriage 50 is supported by a guide shaft 52 for reciprocating scanning in a direction intersecting the direction of conveyance of the recording paper sheet and by a guide rail 111 for holding the rear end of the carriage 50 to retain the clearance between the recording head 7 and the recording paper sheet. The guide shaft 52 is attached to the chassis 11. The guide rail 111 is formed integrally with the chassis 11.

In addition, the carriage 50 is driven by a carriage motor 54, which is attached to the chassis 11, via a timing belt 541. The timing belt 541 is tensioned and supported by an idle pulley 542. The timing belt 541 is coupled to the carriage 50 via a damper 55 made of rubber or the like. The timing belt 541 alleviates image irregularity or the like by damping an oscillation of the carriage motor 54 or the like. In addition, a code strip 561 on which a marking is formed at a pitch of 150 lpi to 300 lpi to detect the position of the carriage 50 is provided in parallel with the timing belt 541. Furthermore, an encoder sensor (not shown) for reading the code strip 561 is provided on a carriage board (not shown), which is mounted on the carriage 50. On the carriage board, a contact for electrically connecting to the recording head 7 is provided. In addition, the carriage 50 is provided with a flexible circuit board 57 for transmitting a head signal from an electric circuit board (not shown) to the recording head 7.

In order to fix the recording head 7 to the carriage 50, the carriage 50 is provided with a positioning unit and a pressing unit. The pressing unit is disposed on a headset lever 51. The pressing unit is configured to act on the recording head 7 when the head set lever 51 is rotated around a rotation fulcrum to set the recording head 7.

In addition, an eccentric cam (not shown) is provided at both ends of the guide shaft 52. Accordingly, the guide shaft 52 can be moved up and down by transmitting a driving force to the eccentric cam via a gear train 581 from a main cam 63 of the cleaning section 6 for carrying out a cleaning processing of the recording head 7. This configuration enables the carriage 50 to move up and down so as to provide an optimum gap for recording paper sheets of different thicknesses in relation to the recording head 7. The driving force to the main cam 63 is transmitted form the motor that is in common use with the cleaning section as described above.

Further, the carriage 50 is mounted with an automatic registration adjustment sensor 59 for automatically correcting any positional deviation of ink ejected from the recording head 7 on the recording paper sheet. The automatic registration adjustment sensor 59 is a reflection type optical sensor. The automatic registration adjustment sensor 59 can obtain an optimum registration adjustment value by emitting light from a light emitting element and receiving reflected light from a predetermined recording pattern on the recording paper sheet.

In the above configuration, when an image is to be recorded on the recording paper sheet, the roller pair composed of the conveyance roller 36 and the pinch roller 37 conveys the recording paper sheet to a line position (the position of the recording paper sheet in the direction of conveyance) at which the image is to be formed, and the carriage 50 is moved by the carriage motor 54 to a row position (the position of the recording paper sheet in the direction intersecting the direction of conveyance) at which the image is to be formed, thus causing the recording head 7 to be opposed to the image forming position. After that, as described above, the recording head 7, responsive to a signal from the electric circuit board, ejects ink to the recording paper sheet to form an image thereon.

(D) Sheet Discharge Section

The sheet discharge section 4 includes two sheet discharge rollers 40 and 41, spurs 42 and 43 that are arranged to be rotatable while following the rotation of the sheet discharge rollers 40 and 41 by contacting the sheet discharge rollers 40 and 41 at a predetermined pressure, a gear train (not shown) for transmitting the driving force of the conveyance roller 36 to the sheet discharge rollers 40 and 41, and the like.

The sheet discharge rollers 40 and 41 are mounted on the platen 34. The sheet discharge roller 41, which is located at a downstream side in the direction of conveyance of the recording paper sheet, is provided with a plurality of rubber portions around a metal shaft. The sheet discharge roller 41 is driven by the driving force transmitted from the conveyance roller 36 via an idler gear (not shown). In addition, the discharge roller 40, which is located at an upstream side of the discharge roller 41, has a configuration such that a plurality of elastic members of elastomer are attached to a plastic shaft. The driving force to the discharge roller 40 is transmitted from the discharge roller 41 via an idler gear (not shown).

The spurs 42 and 43 each are a thin plate made of stainless steel. The spurs 42 and 43 each are provided with a plurality of projecting shapes formed integrally with a plastic portion. In addition, the spurs 42 and 43 each are attached to a spur holder (not shown) via a spur spring (not shown). The spur spring is provided in the shape of a rod of a coil spring and causes the spurs 42 and 43 to press the sheet discharge rollers 40 and 41. The spurs 42 and 43 include spurs that are provided at the positions corresponding to the rubber portion and the elastic member portion of the sheet discharge rollers 40 and 41, having the role of mainly generating a conveyance force for the recording paper sheet. In addition, the spurs 42 and 43 include spurs that are provided at the positions where there are no rubber portion and no elastic member on the sheet discharge rollers 40 and 41, having the role of mainly preventing the recording paper sheet from being lifted up when recording is performed on the recording paper sheet.

Between the sheet discharge rollers 40 and 41, a paper end support (not shown) is provided to pick up both ends of the recording paper sheet and to retain the recording paper sheet beyond the sheet discharge rollers 40 and 41 in order to prevent an image recorded on the previously discharged recording paper sheet from being damaged by being rubbed with the currently discharged recording paper sheet. The paper end support has a configuration such that a plastic member to which a roller is provided at a tip thereof is urged by a paper end support spring to press the roller against the recording paper sheet at a predetermined pressure. Accordingly, both ends of the recording paper sheet are picked up by the paper end support, and the recording paper sheet is held with the stiffness thereof.

With the above configuration, the recording paper sheet on which an image has been formed by the carriage section 5 is held in a nip between the discharge roller 41 and the spur holder 43 and is conveyed to be discharged to a sheet discharge tray 46. The sheet discharge tray 46 can be stored into a front cover 95. The sheet discharge tray 46 is pulled out when the sheet discharge tray 46 is used. The height of the sheet discharge tray 46 is made larger toward the front end thereof. Further, the height of both ends of the sheet discharge tray 46 is made larger. Accordingly, a stacking capability for the discharged recording paper sheet can be improved, and rubbing on a recording surface can be prevented.

(E) U-turn and Automatic Double-side Conveyance Section

The recording paper sheet is stored in a cassette 81, which is provided at the front side of the apparatus. In order to separate and feed the recording paper sheet, a pressure plate 822 for loading the recording paper sheet and causing the recording paper sheet to contact a sheet feed roller 821 is mounted on the cassette 81. The sheet feed roller 821 for feeding the recording paper sheet, a separation roller 831 for separating the recording paper sheet, a return lever 824 for returning the recording paper sheet to the loading position, a unit (not shown) configured to press and control the pressure plate 822, and the like, are attached to a U-turn base 84 of the apparatus body.

The cassette 81 has a contraction configuration with two stages, and each of the stages can be used in accordance with the size of the recording paper sheet. When the paper of a small size is used or when the cassette 81 is not used, the cassette 81 can be contracted and can be stored inside an exterior member 9 of the apparatus body.

The sheet feed roller 821 is circular-arc-shaped in cross section and is rod-shaped. At the side of a paper sheet reference, one sheet feed roller rubber is mounted on the sheet feed roller 821. The recording paper sheet is fed by the sheet feed roller 821. The driving force to the sheet feed roller 821 is transmitted from a U-turn and automatic double-side conveyance motor (not shown) that is provided in the U-turn and automatic double-side conveyance section 5.

The pressure plate 822 is provided with a movable side guide 827, which can be moved so as to regulate the loading position of the recording paper sheet. The pressure plate 822 is rotatable around a rotation shaft (not shown) coupled to the cassette 81. The pressure plate 822 is urged towards the sheet feed roller 821 by a press and control unit composed of a pressure plate spring (not shown) disposed on the U-turn base 84. At a portion of the pressure plate 822 opposed to the sheet feed roller 821, there is provided a separation sheet (not shown) made of a material with a great friction coefficient such as artificial leather for preventing a double feed of the recording paper sheet when the stacking is close to an end. The pressure plate 822 is arranged to contact and separate from the sheet feed roller 821 according to the movement of a pressure plate cam (not shown).

Further, a separation roller holder (not shown), on which the separation roller 831 for separating the recording paper sheet one by one is mounted, is rotatable around a rotation shaft disposed on a separation base (not shown) . The separation roller holder is urged towards the sheet feed roller 821 by a separation roller spring (not shown). The separation roller 831 is provided with a clutch spring. The separation roller 831 is configured such that a portion to which the separation roller 831 is attached is rotatable when a load of a predetermined amount or more is applied. The separation roller 831 can contact and separate from the sheet feed roller 821. The positions of the pressure plate 822, the return lever 824, and the separation roller 831 are detected by a U-turn sensor (not shown).

In addition, the return lever 824 for returning the recording paper sheet to the loading position is rotatably mounted on the U-turn base 84 and is urged in a direction of release by a return lever spring (not shown) . The return lever 824 is rotated by a control cam (not shown) when the recording paper sheet is returned.

In a normal standby state, the pressure plate 822 and the separation roller 831 are released and the return lever 22 returns the recording paper sheet. The return lever 824 is located at the loading position to close an aperture for loading, so that the recording paper sheet does not enter the inside of the recording apparatus through the aperture. When the sheet feeding is started from this standby state, the separation roller 831 is caused to contact the sheet feed roller 821 by the driving of a motor (not shown). Then, the return lever 824 is released, and the pressure plate 822 contacts the sheet feed roller 821. In this state, the feeding of the recording paper sheet is started. The recording paper sheet is restricted by a first-stage restriction unit (not shown) provided on the U-turn base 84. A predetermined number of recording paper sheets only are forwarded to a nip portion constituted by the sheet feed roller 821 and the separation roller 831. The forwarded recording paper sheets are separated at the nip portion, and only a recording paper sheet at the top is fed.

At the downstream side of the sheet feeding portion, two conveyance rollers are provided, namely a first U-turn intermediate roller 86 and a second U-turn intermediate roller 87 for conveying the recording paper sheet which has been fed. The first U-turn intermediate roller 86 and the second U-turn intermediate roller 87 each have a configuration such that an ethylene propylene diene monomer (EPDM) rubber material with a hardness of 40° to 80° is attached at four to six portions of a metal core of the metal shaft. At the positions corresponding to the rubber portions of the first U-turn intermediate roller 86 and the second U-turn intermediate roller 87, a U-turn pinch roller 861 and a U-turn pinch roller 871 for holding the recording paper sheet therebetween are attached to spring shafts (not shown) and are urged towards the first U-turn intermediate roller 86 and the second U-turn intermediate roller 87, respectively. In addition, in order to form a conveyance path, a U-turn inner guide (not shown) that forms the inner side thereof and an outer guide (not shown) that forms the outer side thereof are provided.

When the recording paper sheet reaches the first U-turn intermediate roller 86 and the U-turn pinch roller 861, the pressure plate 822 and the separation roller 831 are released by the control cam. At this time, the return lever 824 is made to return to the loading position by the control cam. In addition, at this time, the recording paper sheet which has reached the nip portion constituted by the sheet feed roller 821 and the separation roller 831 can be returned to the loading position.

The confluence of the sheet conveyance path and the sheet feed section 2 mentioned above is formed by a flapper 883 so that the paths of two sheet feed sections can smoothly meet. When a leading edge of the recording paper sheet is fed to the conveyance roller 36 and the pinch roller 37, the leading edge of the recording paper sheet contacts the nip portion of the roller pair, which has been stopped, so as to carry out a registration operation.

The recording paper sheet on which recording has been performed passes between the conveyance roller 36 and the pinch roller 37 while being conveyed by the conveyance roller 36 and the pinch roller 37. During the automatic double-side recording operation, the trailing edge of the recording paper sheet is conveyed while being held again between the conveyance roller 36 and the pinch roller 37. At this time, since the pinch roller 37 is moved up by an ascending mechanism (not shown), the recording paper sheet is smoothly conveyed.

The recording paper sheet which is fed again is conveyed while being held between a double-side roller 891 and a pinch roller 892. Then, the recording paper sheet is conveyed while being guided by a guide 893. The conveyance path for double-side recording merges with the conveyance path for U-turn conveyance as mentioned above when a conveyance amount exceeds a predetermined amount. Therefore, the configuration and the effect of the conveyance path thereafter are the same as described above.

Next, the detail of the carriage section 5 according to the present embodiment will be described with reference to FIG.

2. The carriage section 5 is mounted with the reflection type automatic registration adjustment sensor 59. The automatic registration adjustment sensor 59 is an optical sensor. A light emission portion and a light receiving portion of the automatic registration adjustment sensor 59 are attached at the positions opposed to the recording paper sheet or the platen 34. The light emission portion of the automatic registration adjustment sensor 59 is capable of changing a light emitting quantity in accordance with an inputted electric power. For example, the light emission portion of the automatic registration adjustment sensor 59 is capable of adjusting a light emitting quantity according to pulse-width modulation (PWM) control so that the light receiving portion can obtain an appropriate amount of reflected light.

In order to carry out the registration adjustment, a comparison is carried out by detecting a reflection optical density in relation to a plurality of predetermined patterns recorded on the recording paper sheet. Therefore, it is preferable that the light emitting quantity is adjusted so that a change in the reflection optical density on the surface of the recording paper sheet and of each of the pattern portions can be detected linearly by the light receiving portion.

In the present embodiment, the detection of the positions of ends of the recording paper sheet in a width direction, namely, the detection of the width of the recording paper sheet, is carried out by using the automatic registration adjustment sensor 59. In order to detect the width of the recording paper sheet, a difference in quantity of reflected light between the recording paper sheet and the platen 34 is utilized. In ordinary cases, the platen 34 is black and the recording paper sheet is white. In this regard, the quantity of reflected light is small on the surface of the platen 34. On the other hand, the quantity of reflected light is large on the surface of the recording paper sheet. Accordingly, a boundary between the platen 34 and the recording paper sheet can be detected. In order to detect the width of the recording paper sheet, it is not necessary to linearly detect a difference in the density. Accordingly, it is possible to set the light emitting quantity within such a range as to enable a difference between the quantity of reflected light from the platen 34 and the quantity of reflected light from the recording paper sheet to be clearly and precisely detected. Therefore, it is possible to increase the light emitting quantity, for example, up to a quantity at which the output from the light receiving portion is saturated by the reflected light from the surface of the recording paper sheet. Thus, it is possible to alleviate the influence of the disturbance in the reflected light quantity occurring due to small smears on the recording paper sheet or ruled lines recorded on the recording paper sheet.

As described above, according to the present embodiment, when the detection of the width of the recording paper sheet is carried out, the light emitting quantity is increased. Accordingly, the width of the recording paper sheet can be detected by the automatic registration adjustment sensor 59.

Second Embodiment

Figure 4:
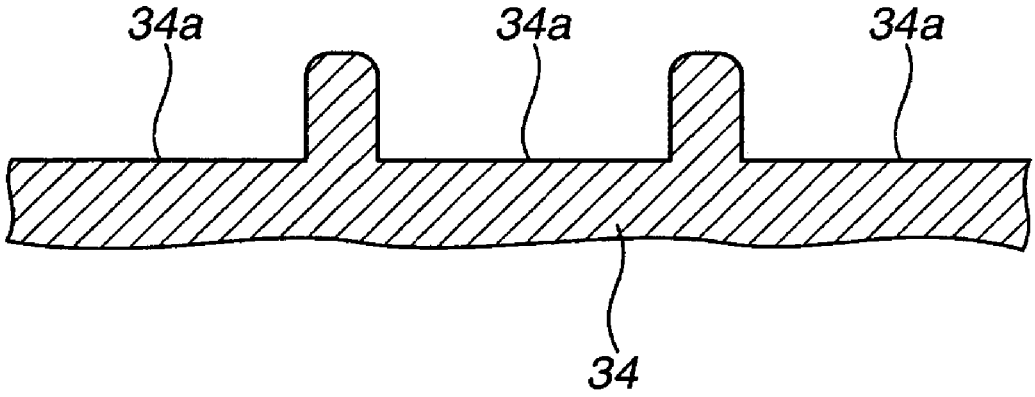
FIG. 4 is a cross sectional view of a platen according to a second embodiment of the present invention.

FIG. 4 is a cross sectional view of a platen according to a second embodiment of the present invention. In the first embodiment, a boundary between the platen and the recording paper sheet can be detected by utilizing the fact that the quantity of reflected light from the platen is small and the quantity of reflected light from the recording paper sheet is large because the platen is black and the recording paper sheet is white. However, depending on the condition of the surface of the platen, a false detection may occur due to the occurrence of strong reflection of light even from the platen.

As shown in FIG. 4, the platen 34 is provided with a plurality of ribs extending in the direction of conveyance of the recording paper sheet. Thus, the recording paper sheet is conveyed while being supported on the upper ends of the ribs. With regard to the position of the end portion of the recording paper sheet in the width direction, whether the end portion of the recording paper sheet in the width direction is on the rib or on a flat surface portion between the ribs is uncertain depending on the type of the recording paper sheet or the state of conveyance. Therefore, it is necessary that the quantity of reflected light from the rib or the flat surface portion is smaller enough than the quantity of reflected light from the recording paper sheet.

Because the smooth surface area of the rib opposed to the sensor is small, most of light emitted from the light emission portion is scattered, and, therefore, the quantity of reflected light returning to the light receiving portion is small enough. On the other hand, the smooth surface area of the flat surface portion may be opposed to the sensor, and accordingly, light emitted from the light emission potion is may be reflected from the flat surface portion to the light receiving portion without being scattered or absorbed.

In this regard, in the second embodiment, the surface of a flat surface portion 34*a* between the ribs of the platen 34 is formed as a textured surface or a frosted surface. Accordingly, the quantity of reflected light from the flat surface portion can be reduced, so that the end portion of the recording paper sheet can be reliably detected.

Third Embodiment

Figure 5:
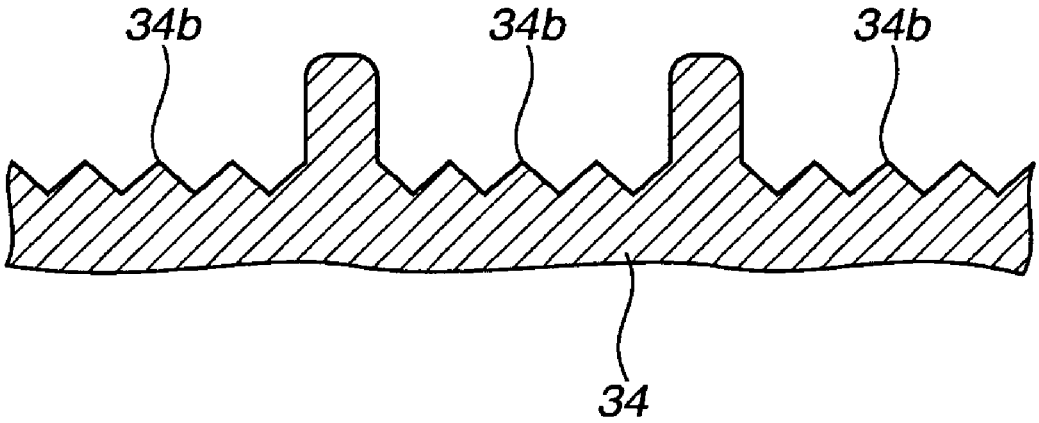
FIG. 5 is a cross sectional view of a platen according to a third embodiment of the present invention.

FIG. 5 is a cross sectional view of a platen according to a third embodiment of the present invention. In the second embodiment, an initial effectiveness may be reduced due to adhesion of ink to the flat surface portion of the platen, which is formed as a textured surface or a frosted surface. In this regard, in the third embodiment, a plurality of grooves 34*b* having a triangle shape in cross section are provided between the ribs. By providing the grooves 34*b*, the number of surfaces opposed to the sensor can be decreased. Accordingly, the quantity of reflected light returning to the light receiving portion can be reduced.

In addition, even in the case of a single flat surface, a similar effect can also be obtained by inclining the surface of the platen with respect to the sensor. Furthermore, the distance between the sensor and the reflective surface may be made larger by having the portion between the ribs deeply recessed. Furthermore, the reflective surface may be eliminated by providing a through hole in the portion between the ribs of the platen.

Fourth Embodiment

As discussed in the embodiments described above, the quantity of reflected light varies greatly in accordance with the shape or position of the platen. On the other hand, the quantity of reflected light from the recording paper sheet is relatively stable. In this regard, in detecting the end portion of the recording paper sheet, it is effective to carry out a detecting operation while moving the sensor from a position opposed to the recording paper sheet to a position not opposed to the recording paper sheet.

Fifth Embodiment

As described in the first embodiment, the recording apparatus is capable of recording on both sides because the recording apparatus is provided with the automatic double-side conveyance section. During the double-side recording, the automatic double-side conveyance section reverses the surface of the recording paper sheet after performing recording on a first surface, and then carries out recording on a second surface. In this instance, when the recording paper sheet is conveyed through the automatic double-side conveyance section, the position of the recording paper sheet in the width direction may vary between the first surface and the second surface. In this regard, in the fifth embodiment, the position of the end portion of the recording paper sheet in the width direction at the time of recording on the first surface and the position of the end portion of the recording paper sheet in the width direction at the time of recording on the second surface are detected. Then, based on a relative positional difference between the detected positions, a recording position at the time of recording on the second surface is corrected. Accordingly, the mutual deviation of the recording positions on the first surface and the second surface can be eliminated.

According to each of the embodiments of the present invention, because an end portion in the width direction of a recording medium to be conveyed is detected by a sensor disposed on a carriage to detect an image recorded on the recording medium, the width and the position of the recording medium can be detected with a simple configuration. Accordingly, a recording apparatus in which any positional deviation of an image does not occur can be provided.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims priority from Japanese Patent Application No. 2004-301372 filed Oct. 15, 2004, which is hereby incorporated by reference herein in its entirety.

What is claimed is:

1. A recording apparatus comprising:

a recording head configured to be used in forming an image onto a recording medium;

a conveyance roller configured to convey the recording medium;

a carriage configured to reciprocate, wherein the recording head is mounted on the carriage;

a platen configured to support the recording medium at a position that is opposed to a position of the carriage; and an optical sensor unit that is disposed on the carriage and configured to emit a quantity of light to read patterns recorded on the recording medium with the recording head so as to automatically adjust a registration operation of a recording position, wherein the optical sensor unit includes a light emission portion configured to emit a quantity of light as a light emitting quantity and a light receiving portion configured to receive a quantity of reflected light from at least each of the recording medium and the platen, wherein the optical sensor unit is configured to detect an end portion in a width direction of the recording medium supported by the platen while being moved from a position opposed to the recording medium to a position not opposed to the recording medium, wherein the light emission portion is configured to emit a larger quantity of light when the optical sensor unit is detecting the end portion in the width direction of the recording medium than when reading the patterns recorded on the recording medium, and wherein, when the optical sensor unit is detecting the end portion, the light emitting quantity from the light emission portion is increased to a quantity at which an output of the light receiving portion is saturated by the reflected light received from the recording medium and is not saturated by the reflected light received from the platen.

2. The recording apparatus according to claim 1, wherein, when the optical sensor unit is reading the patterns recorded on the recording medium, the light emitting quantity is adjusted until the output of the light receiving portion detects a change in a reflection optical density of the patterns.

3. The recording apparatus according to claim 1, wherein the light emitting quantity is adjusted by pulse-width modulation control.

4. The recording apparatus according to claim 1, wherein the platen includes a plurality of ribs that extend in a direction of conveyance of the recording medium, and wherein the platen includes between the ribs one of flat surface portions that have one of textured surfaces and frosted surfaces and a plurality of grooves, wherein each groove is triangular in shape.

* * * * *